US007731769B2

(12) United States Patent
Min

(10) Patent No.: US 7,731,769 B2
(45) Date of Patent: Jun. 8, 2010

(54) CYCLONIC DUST COLLECTION UNIT AND FILTER STRUCTURE THEREOF

(75) Inventor: Young Gun Min, Changwon-si (KR)

(73) Assignee: LG Electronics Inc., Seoul (KR)

( * ) Notice: Subject to any disclaimer, the term of this patent is extended or adjusted under 35 U.S.C. 154(b) by 440 days.

(21) Appl. No.: 11/232,854

(22) Filed: Sep. 23, 2005

(65) Prior Publication Data

US 2006/0137302 A1 Jun. 29, 2006

(30) Foreign Application Priority Data

Dec. 27, 2004 (KR) ..... 10-2004-0113394

(51) Int. Cl.
*B01D 45/00* (2006.01)
*B01D 45/12* (2006.01)

(52) U.S. Cl. ..... 55/337; 55/343

(58) Field of Classification Search ..... 55/337, 55/343

See application file for complete search history.

(56) References Cited

U.S. PATENT DOCUMENTS

| | | | | |
|---|---|---|---|---|
| 3,969,096 | A * | 7/1976 | Richard | 55/455 |
| 5,248,323 | A * | 9/1993 | Stevenson | 95/90 |
| 5,287,591 | A * | 2/1994 | Rench et al. | 15/328 |
| 6,171,356 | B1 * | 1/2001 | Twerdun | 55/337 |
| 6,228,260 | B1 * | 5/2001 | Conrad et al. | 210/304 |
| 6,406,505 | B1 * | 6/2002 | Oh et al. | 55/337 |
| 6,746,500 | B1 * | 6/2004 | Park et al. | 55/343 |
| 6,887,290 | B2 * | 5/2005 | Strauser et al. | 55/283 |
| 7,065,826 | B1 * | 6/2006 | Arnold | 15/353 |
| 2002/0178697 | A1 | 12/2002 | Oh | |
| 2004/0098828 | A1 * | 5/2004 | Oh | 15/353 |
| 2004/0111824 | A1 * | 6/2004 | Vuijk | 15/352 |
| 2006/0123590 | A1 * | 6/2006 | Fester et al. | 15/353 |
| 2006/0236663 | A1 * | 10/2006 | Oh | 55/337 |

FOREIGN PATENT DOCUMENTS

| | | | |
|---|---|---|---|
| EP | 1219223 | A2 | 7/2002 |
| EP | 1 323 370 | A2 | 7/2003 |
| GB | 700791 | | 12/1953 |
| RU | 2230476 | C2 | 6/2004 |
| RU | 2234232 | C2 | 8/2004 |
| RU | 2236813 | C2 | 9/2004 |

* cited by examiner

*Primary Examiner*—Walter D Griffin
*Assistant Examiner*—Amber Orlando
(74) *Attorney, Agent, or Firm*—McKenna Long & Aldridge LLP

(57) ABSTRACT

Provided is a cyclonic dust collection unit for conveniently removing a foreign object filtered therein. The cyclonic dust collection unit includes: a first filtering chamber for filtering a first foreign object having a first size using a cyclone airflow; a second filtering chamber for filtering a second foreign object having a second size smaller than the first size of the first foreign object, the second foreign object being contained in the air passed through the first filtering chamber; a foreign object storing chamber for storing the first and/or second foreign object(s) separated through the first and second filtering chambers; a filter disposed in the first filtering chamber, for separating the first foreign object on an outer surface thereof; and a cutaway hole formed in a longitudinal direction thereof.

17 Claims, 11 Drawing Sheets

CYCLONIC DUST COLLECTION UNIT AND FILTER STRUCTURE THEREOF

BACKGROUND OF THE INVENTION

1. Field of the Invention

The present invention relates to a vacuum cleaner, and more particularly, to a cyclonic dust collection unit, which is accommodated inside a vacuum cleaner. Further, the present invention relates to a filter structure of a cyclonic dust collection unit, which is accommodated inside the cyclonic dust collection unit to filter relatively large foreign object.

2. Description of the Related Art

A vacuum cleaner is used to clean a room or other spaces by sucking air containing foreign objects and filtering the foreign object using vacuum pressure generated therein. In order to filter the foreign objects contained in the sucked air, a dust collection unit with a filtering unit is provided in the vacuum cleaner.

The filtering unit is classified into a porous filter formed of porous material and a cyclone type filter. The porous filter formed of porous material is designed to filter the foreign objects contained in air while the air passes through the filter. The cyclone type filter is designed to filter the foreign objects using cyclone airflow. In order to reuse the porous filter, a user has to clean the filter to remove the foreign objects clogged in the filter. Furthermore, when a large amount of the foreign objects are clogged, the porous filter cannot be reused. Since the cyclone type filter is designed to remove the foreign objects from the air by a rotational air current generated by cyclone airflow, the clogging of the foreign objects in the filter is not incurred. Due to this reason, in recent years, cyclone type filter has been widely used.

In recent years, a multi-cyclone type dust collection unit, in which the cyclone unit is provided in plurality to generate a plurality of cyclone airflows, has been developed. The multi-cyclone airflows improve the foreign object removal efficiency. In addition, since there is no need to additionally provide the porous filter in the dust collection unit, the multi-cyclone type dust collection unit would be advantageous in that the separate filter cleaning is not required.

Also, it is general that the multi-cyclone type dust collection unit is provided, inside the dust collection unit, with a plate type filter for filtering relatively large foreign objects such as a hair or paper piece.

However, in the multi-cyclone type dust collection unit provided with the plate type filter, a long foreign object, such as a hair, wastepaper may be frequently curled on an outer circumference of the plate type filter and piled. When a hair is curled on the filter, cyclonic airflow further increases a curled force, resulting in the hair being wedged on the outer circumference of the filter and never freed from.

Thus, when the amount of foreign objects such as hairs and the like wedged on the outer circumference of the filter increases, a user has to eliminate such foreign objects with a strong force, which is inconvenient.

SUMMARY OF THE INVENTION

Accordingly, the present invention is directed to a cyclonic dust collection unit and a filter structure thereof that substantially obviate one or more problems due to limitations and disadvantages of the related art.

An object of the present invention is to provide a cyclonic dust collection unit and a filter structure thereof that can more easily remove foreign objects wedged on an outer circumference of the filter.

Another object of the present invention is to provide a filter structure suitable for a filter of a cyclonic dust collection unit such that a user can remove a foreign object wedged tightly using a simple tool without applying a large external force.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a cyclonic dust collection unit includes: a first filtering chamber for filtering a first foreign object having a first size using a cyclone airflow; a second filtering chamber for filtering a second foreign object having a second size smaller than the first size of the first foreign object, the second foreign object being contained in the air passed through the first filtering chamber; a foreign object storing chamber for storing the first and/or second foreign object(s) separated through the first and second filtering chambers; a filter disposed in the first filtering chamber, for separating the first foreign object on an outer surface thereof; and a cutaway hole formed in a longitudinal direction thereof.

In another aspect of the present invention, there is provided a filter structure of a dust collection unit having a filter provided inside a filtering chamber for filtering a foreign object using a cyclone airflow, the filter structure including: a filter body formed of reinforced plastic material in a body of the filter, through which foreign object-filtered air flows; and a cutaway hole formed in the filter in a longitudinal direction of the filter, for removing trapped on the filter body.

In a still another aspect of the present invention, there is provided a cyclonic dust collection unit including: a first filtering chamber for filtering a first foreign object having a first size using a cyclone airflow; a second filtering chamber for filtering a second foreign object having a second size smaller than the first size of the first foreign object, the second foreign object being contained in the air passed through the first filtering chamber; a foreign object storing chamber for storing the first and/or second foreign object(s) separated through the first and second filtering chambers; a communication hole formed in an upper surface wall defining the first filtering chamber; a filter fixed to a lower side of the communication hole and having a hole through which air passes but the foreign object is filtered; and a cutaway hole formed in a direction inclined with respect to the cyclone airflow.

According to the present invention, a user can more conveniently remove a foreign object wedged on an outer circumference of the filter, and can easily cut away and remove a long foreign object, such as a hair, using a knife.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

Figure 1:
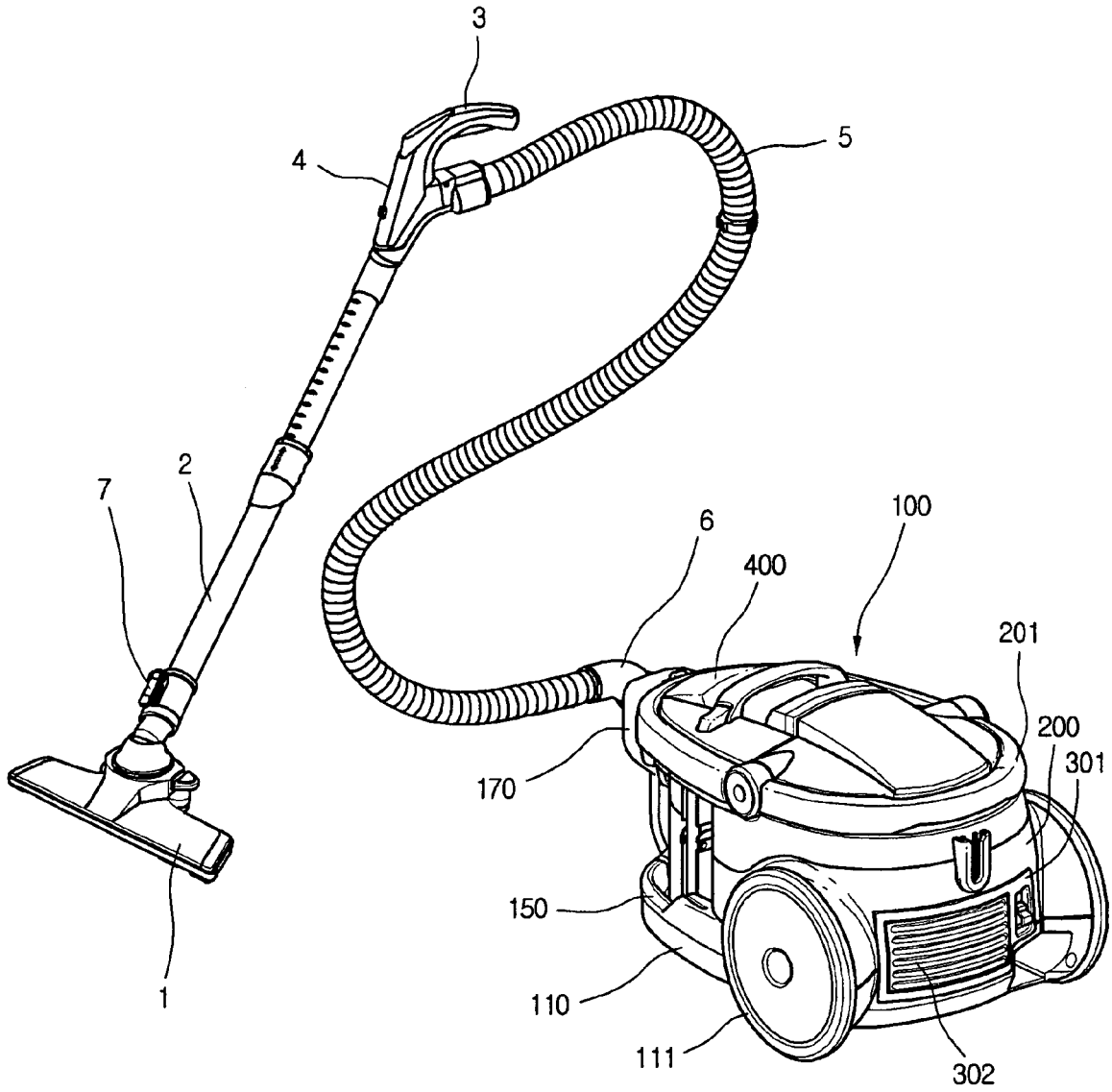
FIG. 1 is a perspective view of a vacuum cleaner where a dust collection unit of the present invention can be employed.

FIG. 1 shows a vacuum cleaner to which a dust collection unit according to the present invention can be applied.

Referring to FIG. 1, a vacuum cleaner includes a main body 100 and a suction assembly connected to a suction portion. Disposed in the main body 100 are a motor (not shown), a suction fan (not shown), and a dust collection unit (not shown). Therefore, the sucked air is exhausted out of the main body 100 after foreign objects contained in the sucked air are filtered.

The suction assembly is provided to suck the air containing the foreign objects when sucking force is generated in the main body 100. That is, the suction assembly includes a sucking nozzle body 1 for sucking the air containing the foreign objects using a powerful airflow, an expandable tube 2 extending from the sucking nozzle body 1 and expandable and contractible by a user, an operation handle 3 provided on a distal end of the expandable tube 2, a manipulation unit 4 provided on a front portion of the operation handle 3, a flexible tube 5 extending from the operation handle 2, a connector 6 connecting a distal end of the flexible tube 5 to the main body 100, a pipe rest 7 on which the expandable pipe 2 can be supported and suspended when the vacuum cleaner is not used.

The connector 6 functions as a connection terminal transmitting a manipulation signal inputted by the user through the manipulation unit 4 to the main body 100 as well as a passage through which the sucked air is introduced into the main body 100. That is, a plurality of electric connection terminals are provided on a proximal end of the connector 6. However, the electric connection terminals are required only when the manipulation unit 4 is provided on the suction assembly. That is, when the manipulation unit 4 is provided on the main body 100, the electric connection terminals are not provided on the connector 6. In this case, the connector 6 may simply function as an air introducing passage.

The air introduced into the main body 100 through the suction assembly is exhausted out of the main body 100 after the foreign objects contained in the introduced air are filtered. The main body 100 of the vacuum cleaner will be described in more detail hereinafter with reference to FIGS. 1 and 2.

Figure 2:
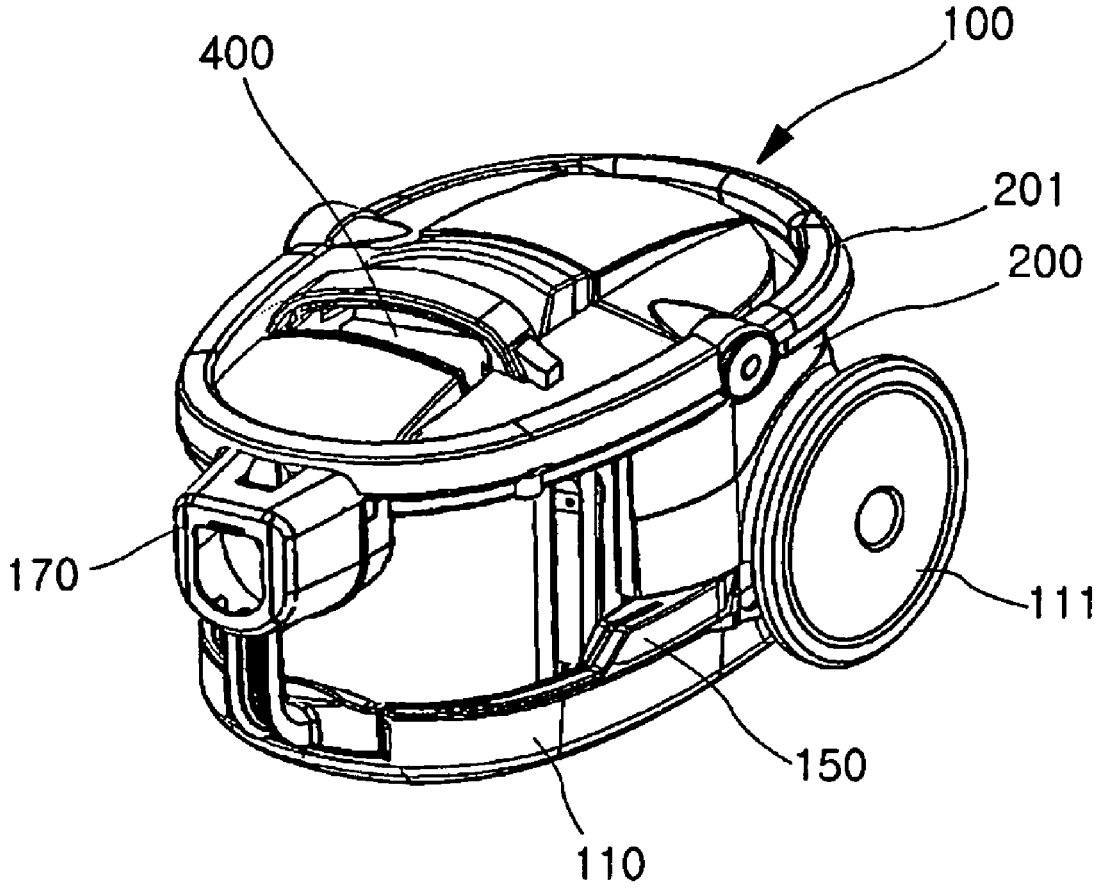
FIG. 2 is a front perspective view of a vacuum cleaner depicted in FIG. 1.

FIG. 2 shows the main body of the vacuum cleaner.

Referring to FIGS. 1 and 2, the main body 100 includes a first base 110 defining a lower portion of the main body 100, a second base 150 disposed on the first base 110, a cover 200 disposed on the second base 150, wheels 111 provided on both rear-side portions of the cover 200 to make it easy to move the main body 100, and a front support 70 for supportably fixing the cover 200 and the first and second bases 110 and 150.

The connector 6 is connected to the front support 170 to allow the outer air to be introduced into the main body 100. The support 170 is designed to support the cover 200 and the first and second bases 110 and 150, thereby securely supporting the front portion of the main body 100.

The second base 150 is provided right above the first base 110 to improve the ornament of the main body and enhance the rigidity of the lower portion of the main body.

An exhaust cover 301 provided with a plurality of exhaust holes 302 is provided on a rear portion of the cover 200 to exhaust clean air. A carrying handle 201 is pivotally provided on a top surface of the cover 200. When a user intends to carry the main body 100, the user pivots the carrying handle 201 in a vertical position and conveniently carries the main body 100 with his/her hand grasping the carrying handle 201.

A dust collection unit 400 is disposed in the main body in rear of the front support 170 and a cyclone member is received in the dust collection unit to generate cyclone airflows and filter the foreign object contained in the air.

Figure 3:
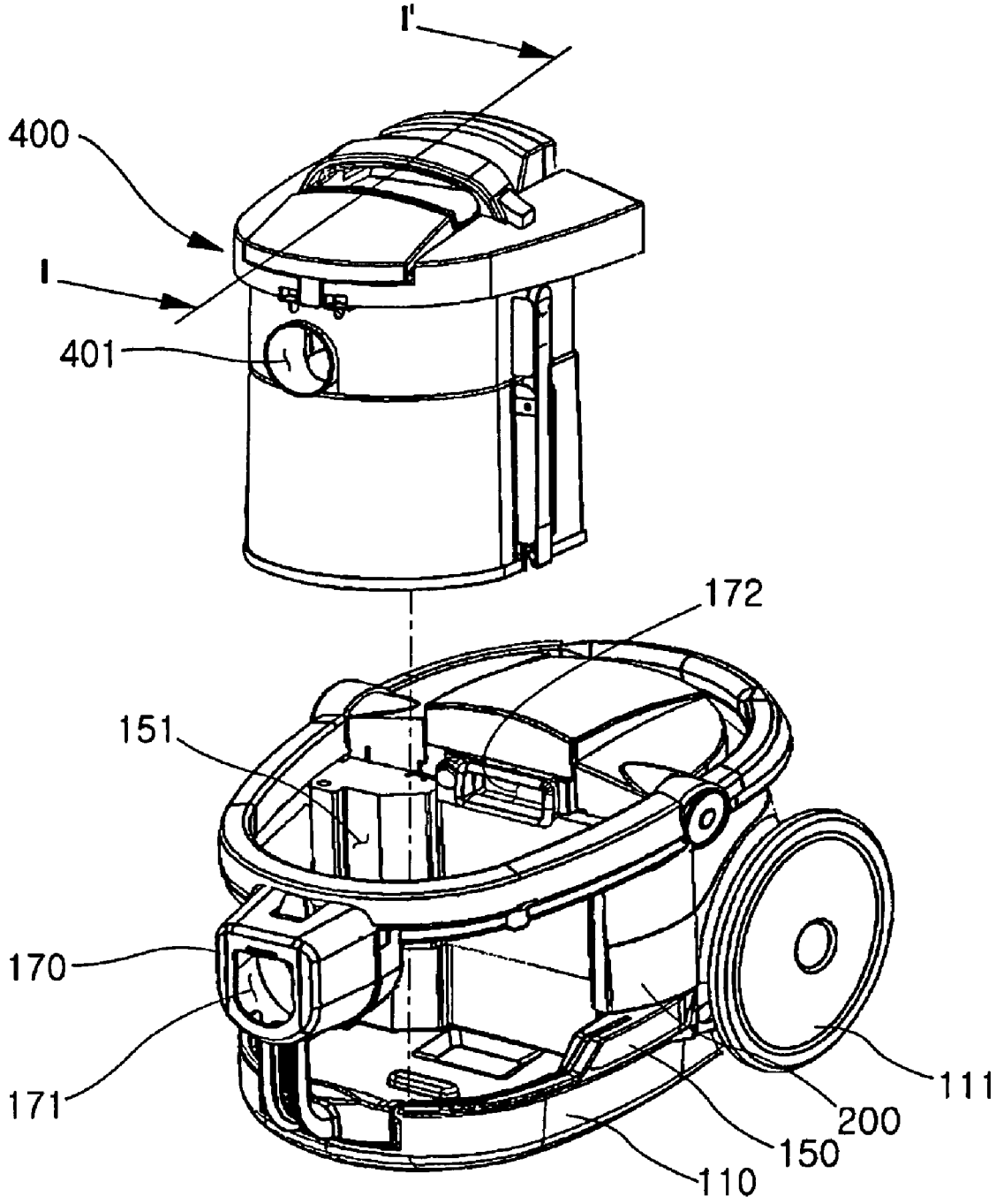
FIG. 3 is a perspective view illustrating a vacuum cleaner main body and a dust collection unit according to an embodiment of the present invention, which is separated from the vacuum cleaner main body.

As shown in FIG. 3, the dust collection unit 400 is vertically installed in and separated from a receiving chamber 151 defined in the main body 100. That is, the dust collection unit 400 may be installed in the receiving chamber 151 by being pushed downward and separated from the receiving chamber 151 by being pulled upward.

The front support 170 is provided with a first air intake hole 171 and the dust collection unit 400 is provided with a second air intake hole 401 corresponding to the first air intake hole 171. The dust collection unit 400 is further provided with an exhaust hole (not shown) opposite to the second air intake hole 401. The exhaust hole is aligned with a third air intake hole 172 formed toward the motor so that the air cleaned by passing through the collection unit 400 is exhausted toward the motor side.

Particularly, the third air intake hole 172 is formed in a rectangular shape lengthwise in a horizontal direction so as to reduce the size of the main body 100 and allow the air to effectively flow.

Figure 4:
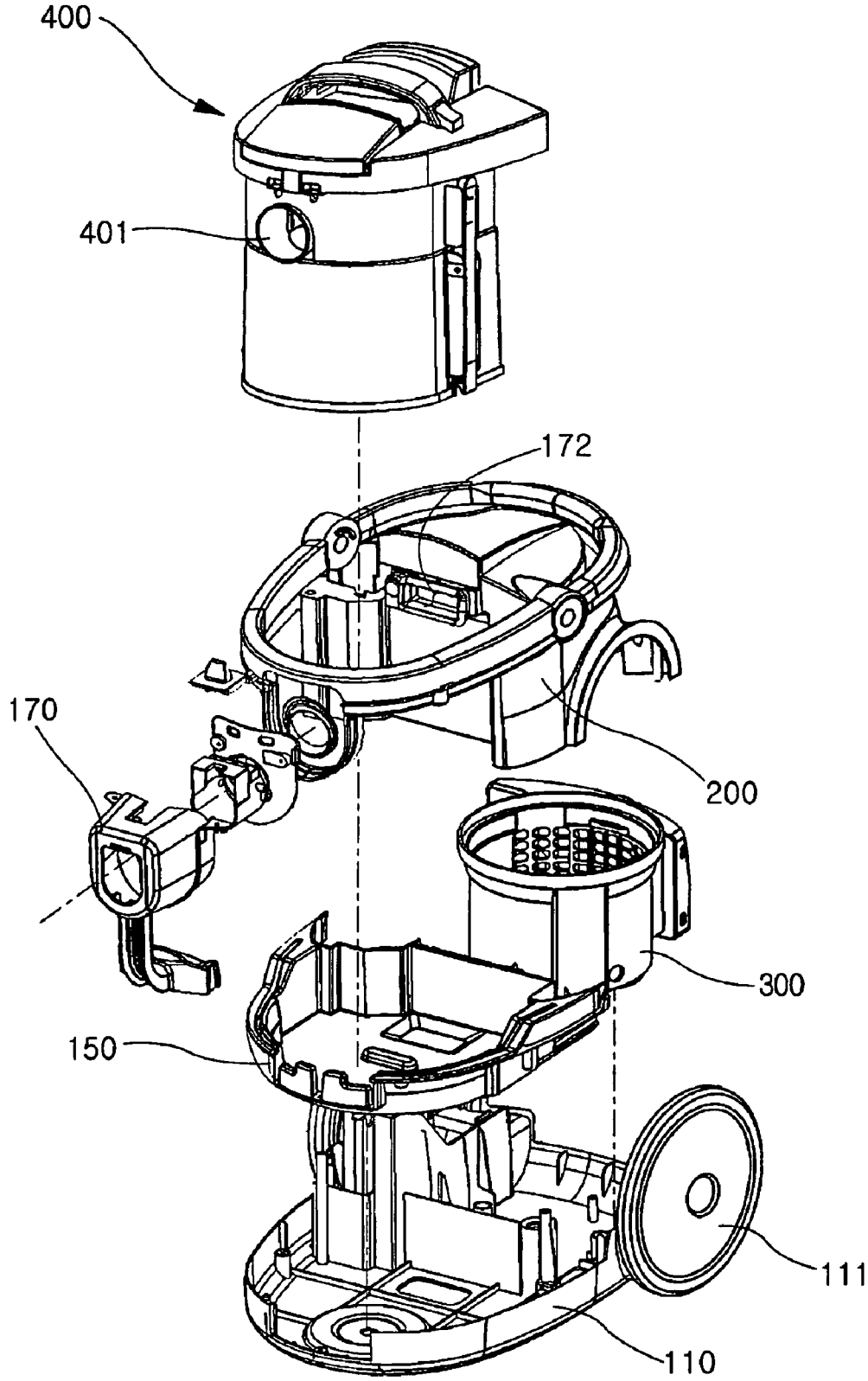
FIG. 4 is an exploded perspective view of a main body of a vacuum cleaner where a dust collection unit according to an embodiment of the present invention is employed.

FIG. 4 shows the main body of the vacuum cleaner.

Referring to FIG. 4, the second base 150 is disposed on a rear-top portion of the first base 110. A motor housing 300 is disposed on a rear portion of the first base 110. Then, the cover 200 is coupled to the first and second bases 110 and 150 to define the main body 100.

Here, the cover 200 is coupled to the first and second bases 110 and 150 in a state where the front support 170 is coupled to the cover 200. A flowing direction of the air introduced into the motor housing 300 through the third air intake hole 172 is changed by 90° in a vertical direction and is then changed in a horizontal direction so that the air can be exhausted rearward.

Figure 5:
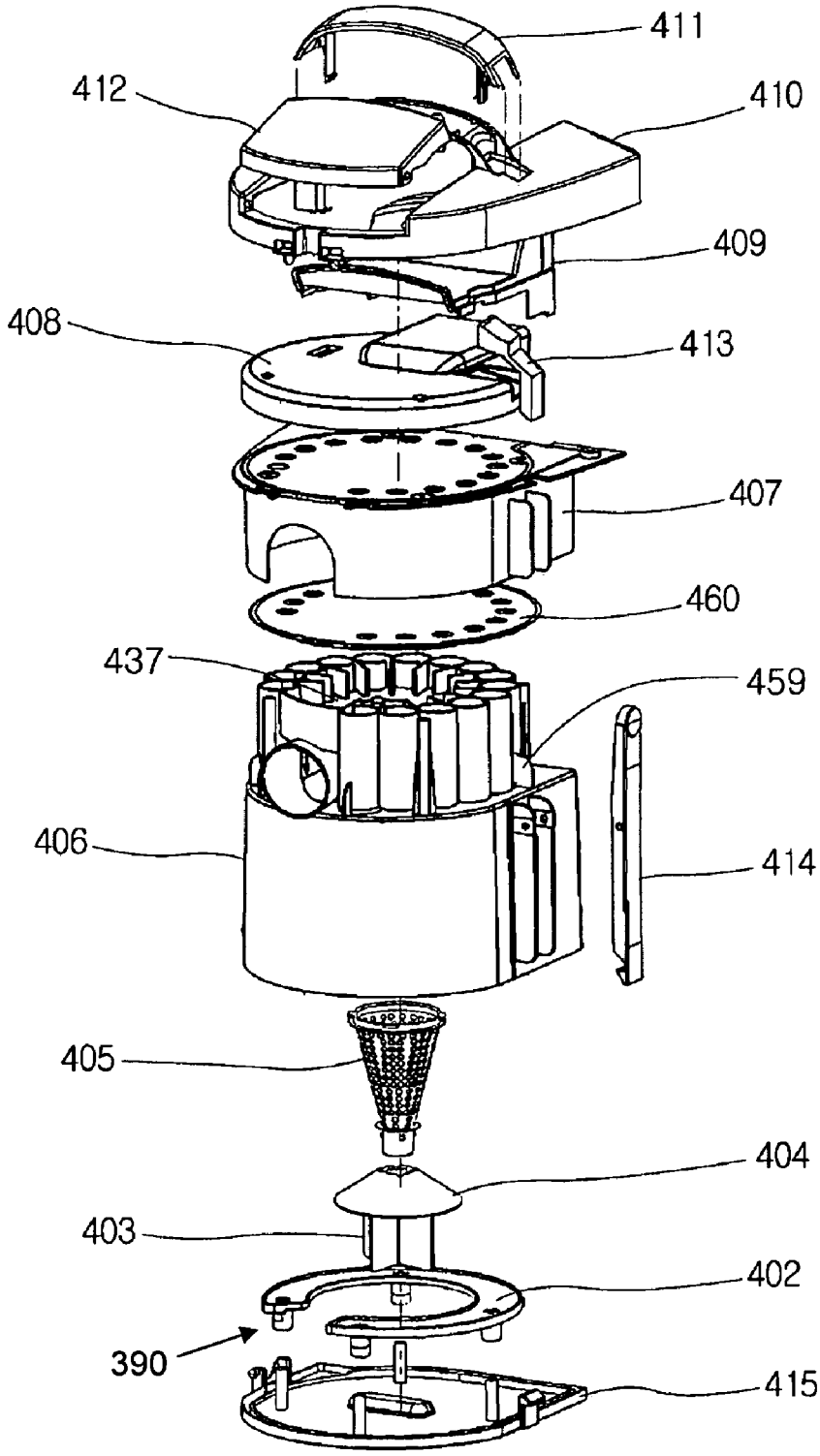
FIG. 5 is an exploded perspective view of a dust collection unit depicted in FIG. 4.

FIG. 5 shows the dust collection unit according to an embodiment of the present invention.

Referring to FIG. 5, the inventive dust collection unit 400 does not use a porous filter such as a sponge. That is, the inventive dust collection unit 400 is designed to filter the foreign objects using cyclone airflows. The cyclone airflow is generated at least two chambers separated from each other so that even the micro-scale dusts contained in the air can be filtered. This will be described in more detail hereinafter.

The dust collection unit 400 includes a collection body 406 provided with a plurality of filtering chambers (refer to the reference numerals 423 and 424 of FIG. 6) for filtering the foreign objects and a plurality of storing chambers (refer to the reference numerals 417 and 416 of FIG. 6) for storing the filtered foreign objects, chamber seal members 402 and 415 provided to seal a bottom of the collection body 406 and prevent the foreign objects stored in the storing chambers 416 and 417 from leaking, an air exhaust member 407 disposed on the collection body 406 to guide the flow of the air exhausted from the collection body 406, a gap forming member 408 providing a predetermined gap above the exhaust member 407 to allow the air exhausted from the exhaust member 407 to flow in a direction, and a cover assembly disposed on the gap forming member 408.

The cover assembly includes a first cover 410 functioning as a main body of the cover assembly, second and third covers 409 and 412 respectively disposed in rear and front of the first cover 410, a cover fixing member 411 fixing the first and second covers 410 and 409. The cover fixing member 411 is designed to cover a portion of the first cover 410 to improve the outer appearance while simultaneously fixing the first and second covers 410 and 409.

Disposed in the dust collection boy 406 are a cone-shaped filter 405 and a blocking member 404 and airflow preventing plates 403. The cone-shaped filter 405 is provided to effectively filter the foreign objects when the cyclone airflows are generated. The blocking member 404 is disposed under the cone-shaped filter 405 to prevent the collected foreign objects from flying. The airflow preventing plates 403 are formed under the blocking member 404 to lower the airflow rate and to thereby allow the foreign objects to sink to the bottoms of the foreign object storing chambers.

The airflow preventing plates 403 and the blocking member 404 may be integrally formed with each other while the cone-shaped filter 405 may be provided as a separated part.

Since the blocking member 404 can be inserted onto the cone-shaped filter 405 as a separate part, the foreign objects as adhered on the outer wall of the cone-shaped filter 405 can be conveniently removed by separating the blocking member 404 from the cone-shaped filter 405. It is preferable that the cone-shaped filter 405 be made of reinforced plastic material so as to resist against airflow.

In detail, when foreign objects such as hairs, paper or the like are sucked from an outside, they are adhered to the outer wall of the cone-shaped filter 405 to decrease the sucking force. Under the above circumstance, it is required that a user remove the same and clean the cone-shaped filter 405 to an original state. At this time, the user can separate the blocking member 404 from the cone-shaped filter 405 and conveniently remove hairs or the like from the cone-shaped filter 405. The cone-shaped filter 405 is designed such that its diameter decreases as it goes to a lower side thereof, the foreign objects such as hairs can be conveniently removed by pulling them downward.

Further, when the foreign objects are not removed even by an operation pulling them downward, the foreign objects can be removed by inserting a knife or the like along a cutaway hole 470 formed in the body of the cone-shaped filter 405 in a longitudinal direction and downward scratching the foreign objects with the inserted knife.

In addition, an opening/closing button 413 is provided on the first cover 410 and an opening/closing lever 414 having a first end contacting the opening/closing button 413 to pivot when the opening/closing button 413 is pushed. The opening/closing lever 414 has a second end contacting the first chamber sealing member 415. Therefore, when the opening/closing lever 414 is pushed, the opening/closing lever 414 pivots around a predetermined hinge point. When the second end of the opening/closing lever 414 moves away from the first chamber sealing member 415, the first chamber sealing member 415 rotates around a hinge point by its self-gravity and the foreign objects collected in the storing chambers 416 and 417 settled by their self-gravities.

In addition, the chamber sealing members 415 and 402 are designed to respectively seal the bottoms of the foreign object storing chambers 415 and 416. The first chamber sealing member 415 is hinge-coupled to the collection body 406 so that it can be opened by a pivotal motion when it is intended to throw away the foreign objects stored in the first chamber sealing member 415. A separation plate 437 for separating the first and second filtering chambers 423 and 424 from each other and defining an air passage is provided on a top surface of the collection body 406.

A plurality of guide ribs 459 are formed on an outer circumference of the collection body 406 to guide the insertion of the exhaust member 407 around the collection body 406. Each of the guide ribs 459 are gently rounded at an upper corner to effectively guide the insertion.

Figure 6:
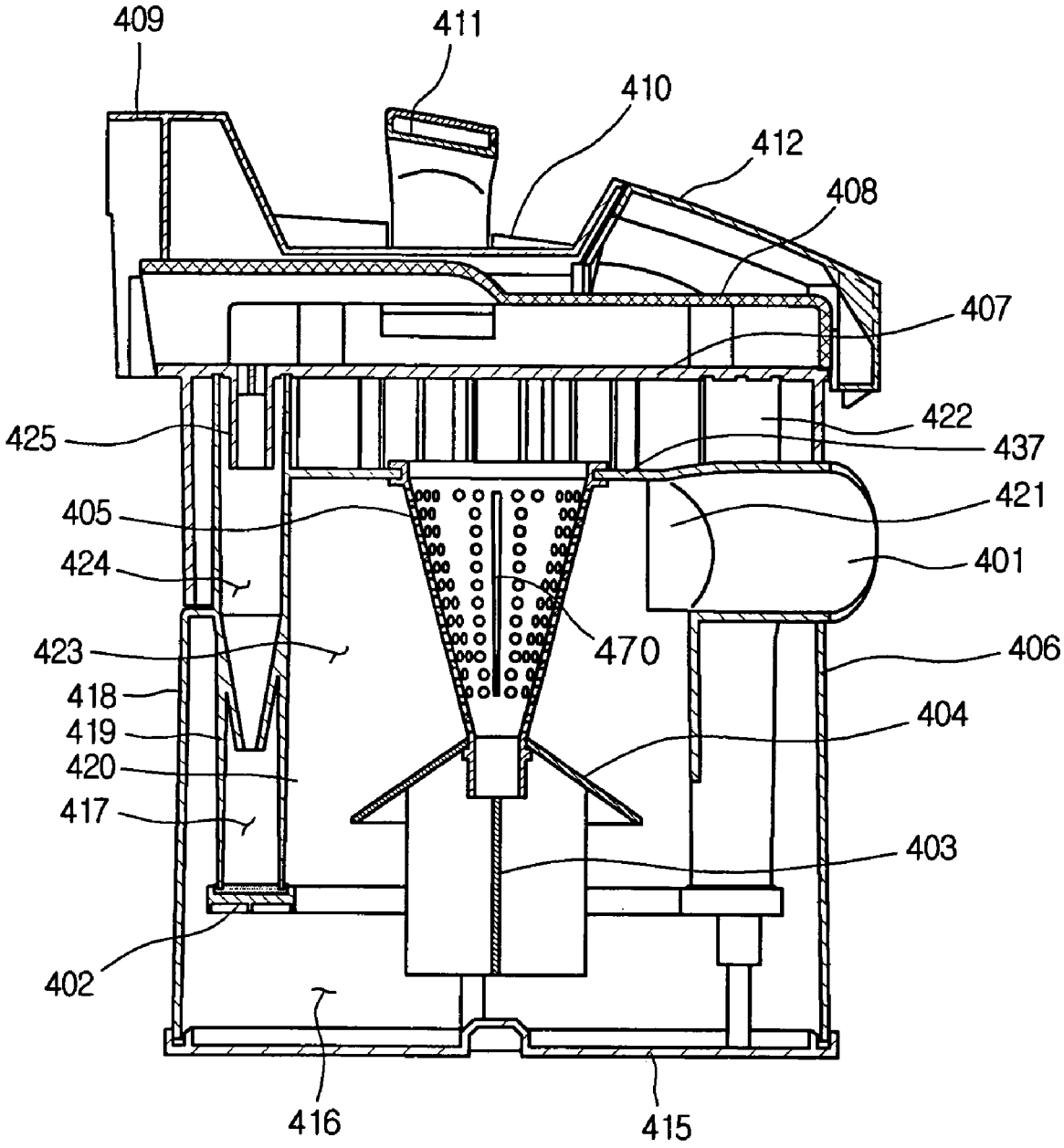
FIG. 6 is a sectional view taken along lines I-I' of FIG. 3.

The internal structure and operation of the dust collection unit 400 will be described in more detail with reference to the sectional view of FIG. 6.

As described with reference to FIG. 5, the dust collection unit 400 includes the collection body 406, the chamber sealing members 402 and 415 provided to selectively seal the bottom of the collection body 406, the cone-shape filter 405 received in the collection body 406 to enhance the dust collection efficiency, the blocking member 404 preventing the foreign objects stored in the collection body 406 from flying, the airflow preventing plates 403 for lowering the airflow rate and for thereby allowing the foreign objects to sink to the bottoms of the foreign object storing chambers, the air exhaust member 407 disposed on the collection body 406 to guide the flow of the air exhausted from the collection body 406, the gap forming member 408 providing a predetermined gap above the exhaust member 407 to allow the air exhausted from the exhaust member 407 to flow in a direction, and covers 409, 410, 411, and 412 disposed on the gap forming member 408.

The collection body 406 includes the outer wall 418, the intermediate wall 419 and the inner wall 420. The outer wall 418 and the intermediate wall 419 are not formed on the portion where the second air intake hole 401 is formed, thereby allowing the air to be effectively introduced.

A space defined between the outer wall 418 and the intermediate wall 419 becomes the first storing chamber 416 and a space defined between the intermediate wall 419 and the inner wall 420 becomes the second storing chamber 417. An inner space defined by the inner wall 420 becomes the first filtering chamber 423. However, the functions of the spaces vary according to the shape of the dust collection unit 400.

The operation of the above-described dust collection unit will be described hereinafter with reference to the airflow.

The air is first introduced into the dust collection unit 400 through the second air intake hole 401. Here, an outer end of the second air intake hole 401 communicates with the front support 170 and an inner end of the second air intake hole 401 communicates with the first filtering chamber 423. A first air introduction guide 421 is projected inward from a portion of the inner wall 420, which defines the inner end of the second air intake hole 401, to guide the air in an inner circumferential direction of the first filtering chamber 423.

When the cyclone airflow is generated in the first filtering chamber 423, the foreign objects contained in the air are settled and the cleaned air is exhausted upward through pores of the cone-shaped filter 405. The second air exhaust hole 401 is formed corresponding to an upper portion of the cone-shaped filter 405, a relatively high RPM cyclone airflow is generated at the upper portion of the cone-shaped filter 405 and a relatively low RPM cyclone airflow is generated at a lower portion of the cone-shaped filter 405. This is the reason for forming the filter 405 in the cone-shape. That is, since a large amount of the foreign objects are forced outward in the relatively high RPM cyclone airflow and a large amount of the foreign objects are forced in the relatively low RPM cyclone airflow, it is preferable that the filter 405 is formed in the cone-shape.

The cone-shaped filter 405 may be detachably seated on a center of the separation plate 437 defining a top wall of the first filtering chamber 423. The cone-shaped filter 405 is typically provided with a plurality of pores through which the air passes.

The blocking member 404 is disposed under the cone-shaped filter 405 to prevent the settled foreign objects from flying. The blocking member 404 has a diameter that is increased as it goes downward to prevent the foreign objects from flying in a reverse direction. The airflow preventing plates are disposed under the blocking member 404 at a predetermined interval to prevent the cyclone airflow form reaching the settled foreign objects, thereby basically preventing the settled foreign objects from flying.

Next, a coupling relationship between the cone-shaped filter 405, the blocking member 404 and the airflow preventing plate 403 will be described in detail.

Figure 7:
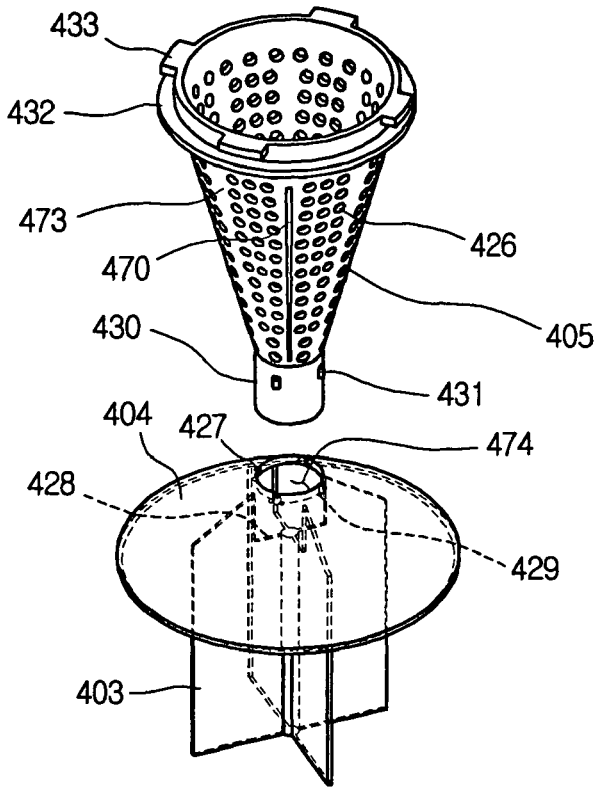
FIG. 7 is an exploded perspective view of a cone-shaped filter and a blocking member that are separated from each other.

FIG. 7 shows the cone-shaped filter and the blocking member that are separated from each other.

As shown in FIG. 7, the cone-shaped filter 405 and the blocking member 404 are individual parts. The airflow preventing plate 403 is integrally formed under the blocking member 404.

As described above, since the blocking member 404 and the cone-shaped filter 405 are formed in individual parts, when it is intended to clean the cone-shaped filter 405, the blocking member 404 is first separated from the cone-shaped filter 405 and then, the foreign objects such as hairs or the like can be easily removed from the cone-shaped filter 405. When the foreign objects wedged on the outer circumference of the cone-shaped filter 405 are not removed from the cone-shaped filter 405 by being simply pulled, the user can insert a sharp member such as a knife or the like into the cutaway hole 470 and move the knife along the cutaway hole 470 downward, thereby conveniently removing the foreign objects. Also, the cutaway hole 470 may be formed inclined at an angle with respect to a horizontal direction, thereby conveniently removing the foreign objects wound in the horizontal direction. It would be easily surmised that the foreign object is wound in the horizontal direction because the airflow direction is the horizontal direction.

In order to easily perform the coupling and separating operation, the filter is formed in the cone shape having a diameter that is reduced as it goes downward. That is, the cone-shaped filter 405 is provided with a plurality of apertures 426 through which the cleaned air passes. The cone-shaped filter 405 is not provided at a lower portion with the apertures 426. The lower portion not having the apertures defines an insertion portion 430, which can be inserted into the blocking member 404. The insertion portion 430 is provided with at least one first projection 431 extending outward. The projection 431 functions to fix the cone-shaped filter 405 on the blocking member 404 when the insertion portion 430 is inserted in the blocking member 404.

In order to allow the cone-shaped filter 405 to be separated from the collection body 406, the cone-shaped filter includes a circumferential seating surface 432 formed on an upper portion of the cone-shaped filter 405 and guide ribs 433 projected on an outer circumferential surface of a top of the cone-shaped filter 405 and distant from the seating surface 432. The seating surface 432 is seated on a bottom of the separation plate 437.

The blocking member 404 is provided at a top with an opening 474 in which the insertion portion 430 can be inserted. An inner circumference defining the opening 474 is provided with an insertion groove 427 in which the first projection 431 is inserted. The plurality of airflow preventing plates 403 disposed in a radial direction are integrally formed on the bottom of the blocking member 404. Upper portions of the airflow preventing plates 403 are cut away to define a receiving portion 428 in which the insertion portion 430 inserted in the blocking member 404 is received. The inner circumference defining the opening 474 is further provided with second projections 429 extending inward at both sides of the insertion groove 427.

Figure 8:
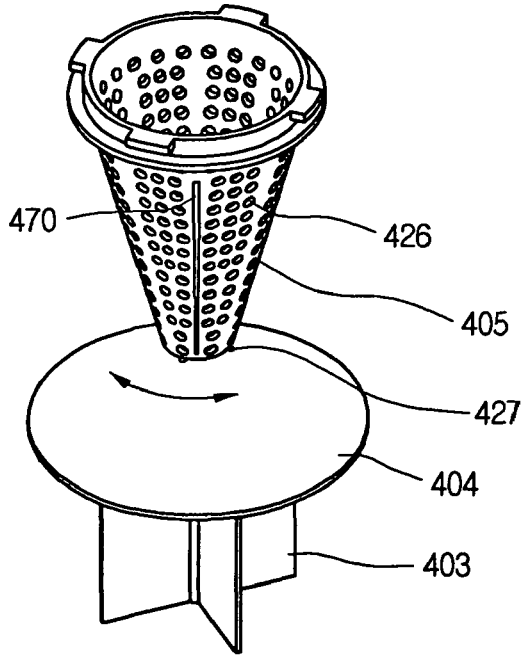
FIG. 8 is a view illustrating an assembling process of a cone-shaped filter and a blocking member.

The coupling operation of the cone-shaped filter 405 and the blocking member 404 will be described with reference to FIG. 8.

First, the blocking member 404 is lifted in a state where the first projection 431 is aligned with the insertion groove 427. When the first projection 431 is not aligned with the insertion groove 427, the insertion portion 430 cannot be inserted. Thus, the user can easily identify the insertion location by rotating the blocking member 404 by a predetermined angle.

Then, when the insertion portion 430 is completely received in the receiving portion 428, the upper end of the blocking member 404 contacts the filter body 473 of the cone-shaped filter 405 and the first projection 431 contacts the second projection 429 by a slight height difference therebetween. In this state, as indicated by arrow in FIG. 8, the blocking member rotates in a direction. Then, the first projection 431 goes over the second projection 429 to realize the clear hooking action. In order to realize the hooking action regardless of the rotational direction of the blocking member 404, the second projection 429 is provided at both side locations of the insertion groove 427. In order for the first projection 431 to go over the inner circumferential surface of the blocking member 404 that is inclined outward as it goes downward, it is preferable that the upper end of the first projection 431 is inclined downward by a predetermined angle.

Meanwhile, the cone-shaped filter 405 includes a filter body 473, and the filter body has a cutaway hole 470 formed long in a longitudinal direction. The cutaway hole 470 is provided for cutting away and easily separate a foreign object, such as a hair as being wedged on the body of the cone-shaped filter 405.

In detail, as the cyclonic dust collection unit 400 operates, a foreign object such as a wastepaper, hairs or the like is wound on an outer circumference of the body of the cone-shaped filter 405. Since the foreign objects such as hairs or the like are entangled as their pile amount increases so that their strength increases, it is difficult to pluck the foreign objects by the user's force alone. Especially, it is very difficult to pluck the foreign objects entangled at the narrowest diameter portion.

In such a circumstance, the user inserts a knife into an upper portion of the cutaway hole and then moves downward such that the hairs are easily cut away and removed. Also, since the foreign objects such as hairs are piled on the outer circumference of the body, the cutaway hole 470 is preferably formed at the filter body 473. Also, the cutaway hole 470 is formed in a longitudinal direction of the filter body, and may be in plurality within a range that the strength of the cone-shaped filter 405 is not lowered.

If the cutaway hole 470 is not formed, the hairs must generally be plucked by a hand or knife. Using a hand is inconvenient for the user because the user generally must apply a large force. Also, when the outer wall of the cone-shaped filter 405 is scratched using a knife without the cutaway hole, the outer circumferential surface of the cone-shaped filter 405 may be damaged, which is not preferred.

While some of the accompanying drawings show that the cutaway hole 470 is formed only at an upper portion of an insertion member 430, the position of the cutaway hole 470 is not limited thereto but may be formed in an overall length extending to a lower portion of the cone-shaped filter 405. In this case, the foreign object may be completely removed by separating the blocking member 404 from the cone-shaped filter 405, inserting a back of the knife into the cutaway hole 470 and passing the knife along the cone-shaped filter downward. Besides the knife, any article having a cuspid can be used such that the user's convenience is further improved. However, if the cutaway hole 470 is formed in the overall length of the cone-shaped filter extending to the lower side of the cone-shaped filter 405, the self-strength of the cone-shaped filter 405 may be lowered, which can be overcome by a method of increasing the thickness of the cone-shaped filter 405.

The cutaway hole 470 is formed in plurality. At this time, the plurality of cutaway holes 470 are arranged at an equal interval. Accordingly, the user can conveniently remove the foreign object through any side of the filter.

Figure 9:
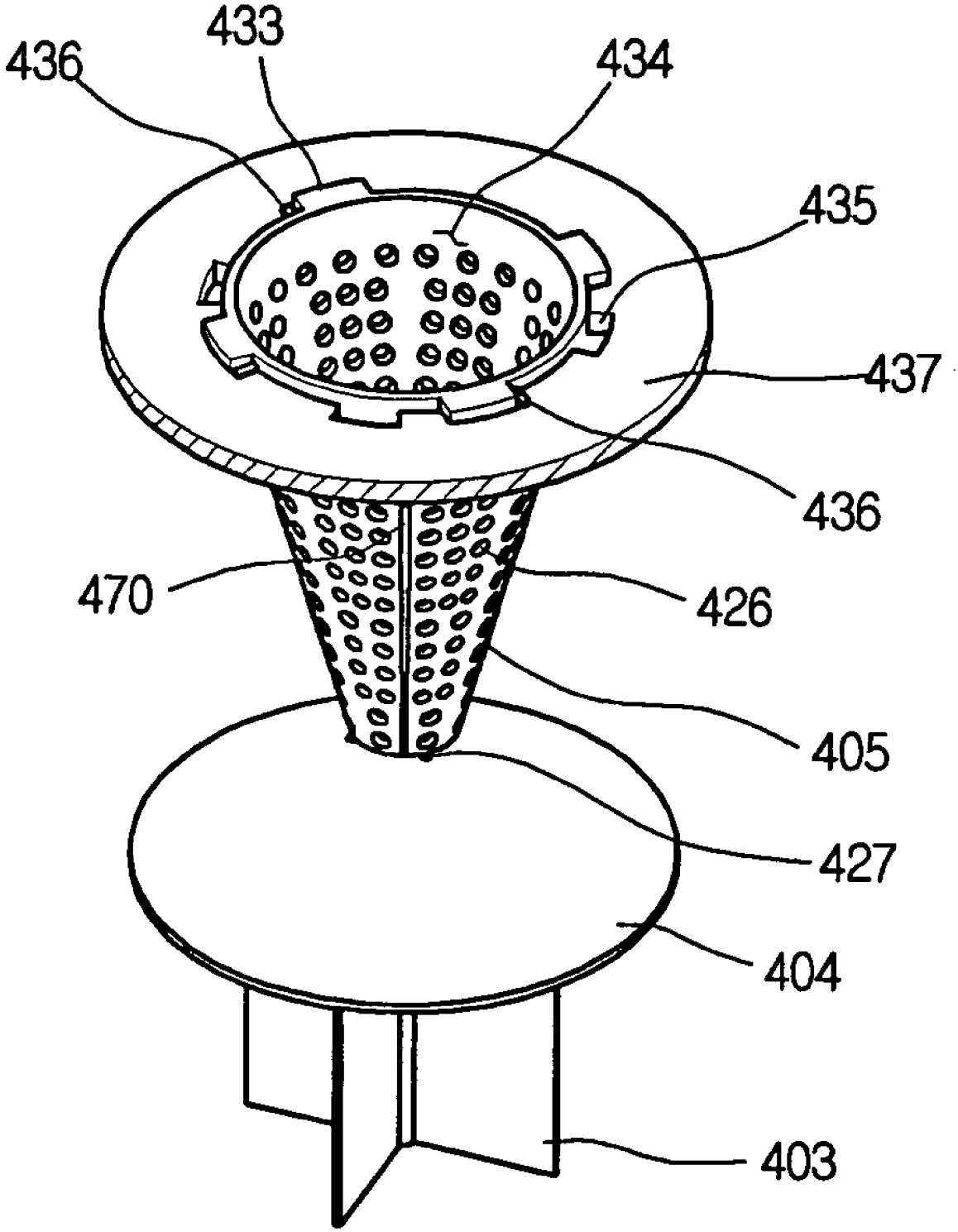
FIG. 9 is a view illustrating an assembled state of a cone-shaped filter and a blocking member.

FIG. 9 shows the coupling relationship between the cone-shaped filter and the collection body.

Referring to FIG. 9, the separation plate 437 is provided with a communication hole 434 through which the air directed from the cone-shaped filter 405 is exhausted. An inner circumference defining the communication hole 434 is provided with a plurality of rib insertion grooves 435 in which the guide ribs 433 are inserted. A third projection 436 is formed on an upper surface of the rib insertion groove 435 at a center portion of the rib insertion groove 435.

When describing the fixing operation of the cone-shaped filter 405, the guide ribs 433 and the rib insertion grooves 435 are aligned with each other by rotating the cone-shaped filter 405. Next, the cone-shaped filter 405 is lifted so that the guide ribs 433 pass through the rib insertion grooves 435. In this state, a gap between the guide ribs and the seating surface 432 is slightly less than a thickness of the separation plate 437.

Here, when the cone-shaped filter 405 rotates, the separation plate 437 is forcedly fitted into the gap between the guide ribs 433 and the seating surface 432, thereby fixing the upper end of the cone-shaped filter 405 on the separation plate 437. When the cone-shaped filter 405 further rotates, the guide rib 433 contacts the third projection 436, thereby stopping the rotation. When the cone-shaped filter 405 cannot rotate any more, the user can identify that the fitting is completed to release the force being applied for the rotation.

As described above, the cone-shaped filter 405 may be fixed on the separation plate 437 as an individual part. The blocking member 404 may be fixed on the cone-shaped filter as an individual part.

Therefore, when the user intends to clean the cone-shaped filter 405, the blocking member 404 is separated from the cone-shaped filter 405 in a state where the cone-shaped filter 405 is fixed on the separation plate 437. In this state, the cone-shaped filter 405 may be cleaned. When it is intended to clean the cone-shaped filter 405 using water, the cone-shaped filter 405 is cleaned in a state where the separation plate 437 is separated therefrom.

In the fixing process, the cone-shaped filter 405 is fixed on the separation plate 437 in a state where the blocking member 404 is separated, after which the blocking member 404 is fixed on the cone-shaped filter. If the cone-shaped filter 405 is fixed on the separation plate 437 in a state where the blocking member 404 is fixed thereon, the user cannot easily find out the location of the cone-shaped filter 405 since the user cannot see the aligned position of the guide ribs 433 and the rib insertion grooves 435 as the field of view of the user is screened by the blocking member 404. That is, this problem can be solved by fixing the cone-shaped filter 405 on the separation plate 437 in a state where the blocking member 404 is separated therefrom.

In the above-described embodiments, the structure such as the projections 431, 429 and 436 may be varied. For example, other hooking structure may be applied. Alternatively, an insertion groove may be formed on the insertion portion 430 and a projection may be formed on the blocking member 404.

Furthermore, when a relatively large airflow preventing plate 403 is required, the airflow preventing plate 403 may be formed as an individual part that can be fixed on the blocking member later.

Again referring to FIG. 6, the foreign objects filtered in the first filtering chamber 423 are stored in the first storing chamber 416 formed under the first filtering chamber 423. A bottom of the first storing chamber 416 is sealed by the first sealing member 415. The air introduced passes through the first filtering chamber 423, in the course of which the relatively large-sized foreign objects contained therein are filtered, and is then directed to the separation plate 437 through the cone-shaped filter 405. Therefore, in order to filter micro-scale foreign objects, additional cyclone airflow is further required. This will be described in more detail hereinafter.

The air passing through the cone-shaped filter 405 is introduced into the second filtering chambers 424 through a second air introduction guide 422. Since the second air introduction guide 422 faces the inner circumference of the second filtering chambers 424 in a tangent direction, the cyclone airflow is generated in the second filtering chamber 424.

The foreign objects filtered in the second filtering chambers 424 by the cyclone airflow are settled in the second storing chamber 417. In order to prevent the settled foreign objects from flying, a width of each of the lower portion of the second filtering chambers 417 are narrowed. In addition, in order to prevent the settled foreign objects from escaping, a bottom of the second storing chamber 417 is sealed by the second chamber sealing member 402.

As illustrated in the embodiment of FIG. 5, the second chamber sealing member 402 has a bar-shaped connection structure 390 to be connected to the first chamber sealing member 415, thereby increasing an inner volume of the first storing chamber 416. That is, since the foreign objects are stored in the space defined between the lower end of the second chamber sealing member 402 and the upper end of the first chamber sealing member 415, it is preferable that the connection structure 390 is formed in a bar-shape that can occupy a small space.

The air whose foreign objects are filtered in the second filtering chamber 424 is introduced into the exhaust member 407 via an exhaust side air intake hole 425 and collected in a space between the exhaust member 407 and the gap forming member 408. Here, a diameter of the exhaust side air intake hole 425 is less than an inner diameter of the second filtering chamber 424 so as to prevent the foreign objects in the second filtering chamber 424 from being directed to the exhaust member 407. That is, the foreign objects collected on the inner circumference of the second filtering chambers 424 are not exhausted through the exhaust side air intake hole 425.

The air whose foreign objects are filtered in the first and second filtering chambers 423 and 424 by the cyclone airflows is directed to the motor and then exhausted through the rear surface of the main body 100.

Meanwhile, the cover assembly is further formed on an upper portion of the gap forming member 408. The cover assembly includes the first cover 410, the second and third covers 409 and 412 covering the rear and front portions of the first cover 410, and the cover fixing member 411 fixing the second cover 409 to the first cover 410.

The operation of the above-described dust collection unit 400 and the overall operation of the main body 100 of the vacuum cleaner will be described hereinafter with reference to FIG. 10.

Figure 10:
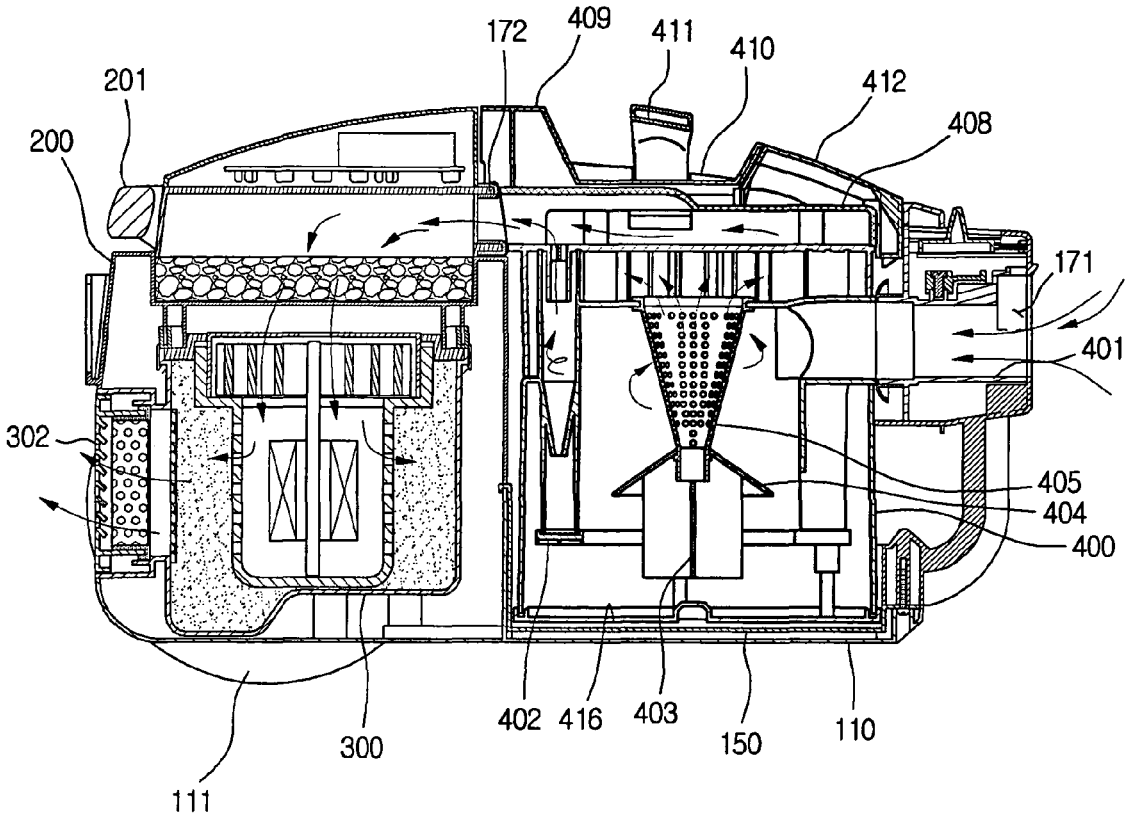
FIG. 10 is a longitudinal sectional view of a vacuum cleaner where a dust collection unit of the present invention is applied.

Referring to FIG. 10, outer air is introduced into the main body 100 through the air intake hole 171 of the main body 100 and is then introduced into the dust collection unit 400 through the air intake hole of the dust collection unit. The foreign objects contained in the air are filtered in the dust collection unit 400 as described above and are then introduced into the motor housing 300 in a horizontal direction. The air introduced into the motor housing 300 in the horizontal direction moves downward to be exhausted through the exhaust holes 302 formed on the rear surface of the main body 100.

The above embodiments disclose a cyclonic dust collection unit and filter structure thereof having an improved collection efficiency of foreign object. By the above spirit of the present invention, the collection efficiency of foreign object is enhanced and foreign object wound on the filter can be conveniently removed.

As aforementioned, the present invention is characterized by conveniently removing the foreign object wound on an outer circumference of the filter. Hereinafter, another embodiments to attain such an effect of the present invention will be described.

Figure 11:
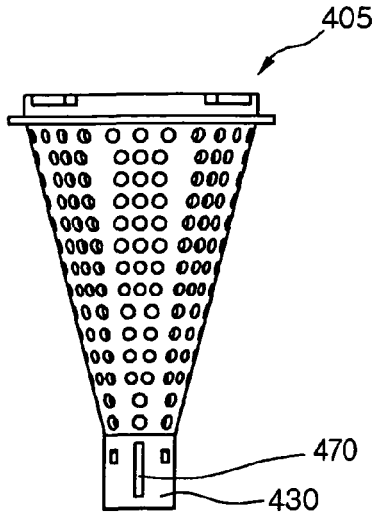
FIG. 11 is a front view of a filter according to another embodiment of the present invention.

FIG. 11 is a front view of a filter according to another embodiment of the present invention.

Referring to FIG. 11, the filter of the present embodiment is the same as that of the previous embodiment except for position and shape of the cutaway holes. Specifically, the cutaway hole 470 in the present embodiment is formed in an insertion member 430 unlike in the previous embodiment that the cutaway hole 470 is formed in the filter body 473. When the cutaway hole 470 is formed in the insertion member 430 as the present embodiment, it is possible to contact foreign objects wound on the filter body 473 downward and at once cut away the foreign objects.

The following embodiments may be provided, when the cutaway hole 470 is formed in the longitudinal direction, for maintaining the strength of the cone-shaped filter 405.

Figure 12:
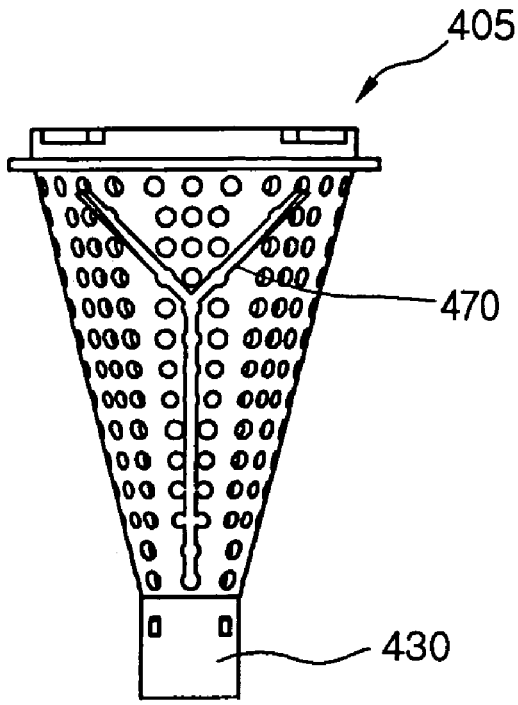
FIG. 12 is a front view of a filter according to a further embodiment of the present invention.

FIG. 12 is a front view of a filter according to a further embodiment of the present invention.

Referring to FIG. 12, the filter of the present embodiment is the same as that of the previous embodiment except for shape of the cutaway hole shape in "Y". In other words, the cutaway hole of the present embodiment includes a vertical hole and a branch hole branched from a sidewall of the vertical hole.

Of course, the branch hole can be formed at any height as well as at an upper side of the vertical hole. It is preferable that the branch hole be formed inclined with respect to the vertical hole. By doing so, it is possible to easily find out the position of the cutaway hole, especially, the position of the branch hole by contacting a surface of the filter downward or upward from a predetermined point. Also, by scratching the filter along the cutaway hole with a knife, it is possible to more easily cut away hairs or the like.

Figure 13:
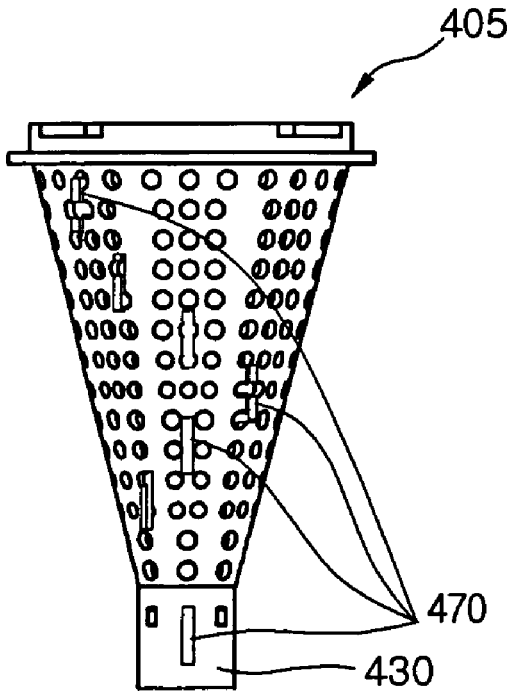
FIG. 13 is a front view of a filter according to a further another embodiment of the present invention.

FIG. 13 is a front view of a filter according to still another embodiment of the present invention.

Referring to FIG. 13, the filter of the present embodiment is the same as that of the previous embodiment except that the cutaway hole is formed in a longitudinal direction at several sites. The filter 405 having the cutaway holes designed as in the present embodiment prevent as above prevent its strength from being lowered due to the cutaway holes, and can be conveniently applied when it is intended to remove the foreign objects concentratively wound on a specific portion of the cone-shaped filter 405.

Figure 14:
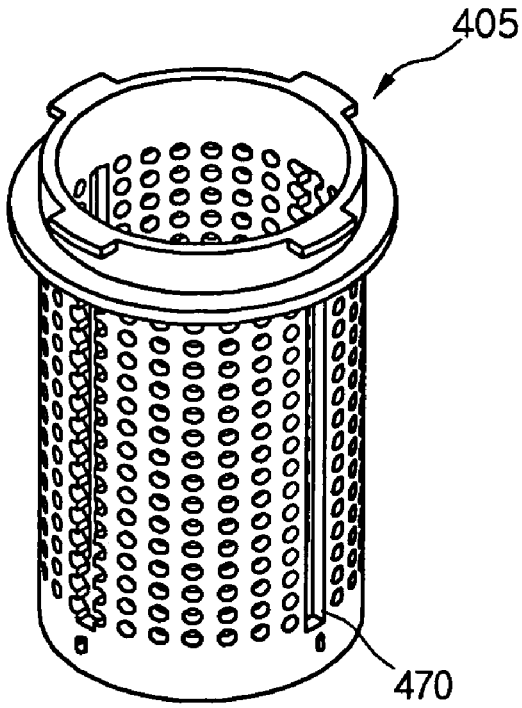
FIG. 14 is a perspective view of a filter according to still another embodiment of the present invention.

FIG. 14 is a front view of a filter according to a further still another embodiment of the present invention.

Figure 15:
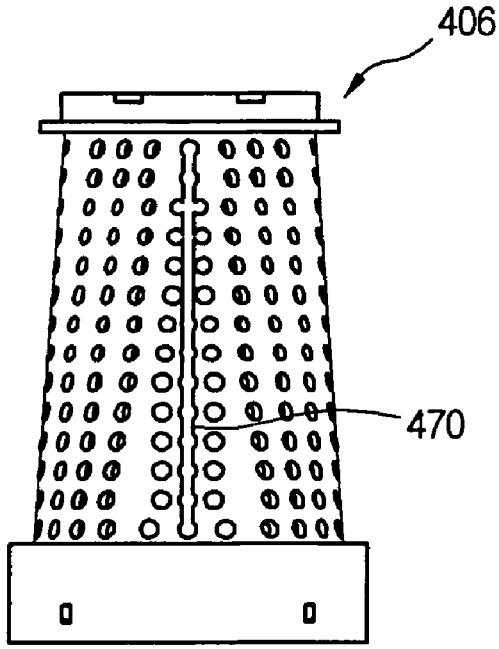
FIG. 15 is a front view of a trapezoid filter according to still another embodiment of the present invention.

Referring to FIG. 14, the filter of the present embodiment is the same as that of the previous embodiment except that it does not have a conical shape but have a cylindrical shape. The cylindrical filter 471 exemplarily shows that though the filter structure is different due to a changed shape of the dust collection unit or the like, the cutaway hole can be formed. Meanwhile, FIG. 15 shows an example of a trapezoid filter. Referring to FIG. 15, it is understood that a change in the structure of airflow passage of the dust collection unit enables employing the trapezoid filter having a cutaway hole 470, thereby easily removing the foreign object such as hairs.

The filters disclosed in the above embodiments are made of reinforced plastic material such that the plastic material can maintain a strength for the formation of the cutaway hole.

It will be apparent to those skilled in the art that various modifications and variations can be made in the present invention. Thus, it is intended that the present invention covers the modifications and variations of this invention provided they come within the scope of the appended claims and their equivalents.

According to the present invention, it is advantageous to easily remove the foreign object such as hairs or the like wound on the filter in the cyclonic dust collection unit.

Also, although the airflow structure of the dust collection unit, the shape of the filter, the pile position of the foreign object or the like is changed, one or more cutaway holes formed in or inclined with respect to the longitudinal direction of the filter are provided to easily remove the foreign object such as hairs wedged on the filter.

Further, the filter of the present invention is applicable to the multi-cyclone type dust collection unit, and or more preferably applicable to a vacuum cleaner not having porous filtering means, thereby capable of easily removing the foreign object such as hairs wound inside the dust collection unit.

What is claimed is:

1. A cyclonic dust collection unit comprising:

a dust collection body;

a first filtering chamber, disposed within the dust collection body, to filter a first type of foreign object(s) having a first size using a cyclone airflow;

a second filtering chamber, disposed within the dust collection body, to filter a second type of foreign object(s) having a second size smaller than the first size, the second type of foreign object(s) being contained in the air passed through the first filtering chamber;

a first foreign object storing chamber for storing filtered object(s) separated through the first filtering chamber, the first foreign object storing chamber provided with a first chamber seal member adapted to releasably seal the first foreign object storing chamber, the first foreign object chamber having a side defined by at least a portion of the dust collection body and a bottom defined by the first chamber seal member;

a second foreign object storing chamber for storing filtered object(s) separated through the second filtering chamber, the second foreign object storing chamber provided with a second chamber seal member adapted to releasably seal the second foreign object storing chamber, the second foreign object storing chamber having a bottom defined by the second chamber seal member, the bottom of the second foreign object storing chamber being above the bottom of the first foreign object storing chamber;

a connection structure adapted to connect the first and second chamber seal members, the connection structure comprising a plurality of spacers distinct from the dust collection body and extending between a top surface of the first chamber seal member and a bottom surface of the second chamber seal member, and configured such that the first and second chamber seal members release from the first and second foreign object storing chambers, respectively, as one structure;

a filter disposed in the first filtering chamber and having a plurality of apertures, for separating the first type of foreign object(s) at an outer surface thereof;

a separation plate disposed on the upper portion of the filter, the separation plate having a communication hole through which the air directed from the filter is exhausted;

an insertion portion formed at a lower part of the filter;

a blocking member disposed under the filter to prevent filtered foreign objects from flying, the blocking member having an opening adapted to receive the filter insertion portion;

a plurality of airflow preventing plates disposed in a radial direction formed on the bottom of the blocking member to prevent the cyclone airflow from reaching the settled foreign objects, and a cutaway hole formed on the filter, having a length that is greater than a width thereof, and extending along a length of the filter.

2. The cyclonic dust collection unit according to claim 1, wherein the first filtering chamber is formed of reinforced plastic material.

3. The cyclonic dust collection unit according to claim 1, wherein the filter has a conical or a cylindrical shape the diameter of which decreases as it goes downward, or a trapezoid shape the width of which decreases as it goes downward.

4. The cyclonic dust collection unit according to claim 1, wherein the cutaway hole is in plurality.

5. The cyclonic dust collection unit according to claim 1, wherein the cutaway hole comprises a vertical hole formed in a longitudinal direction and a branch hole branched from the vertical hole at a predetermined angle.

6. The cyclonic dust collection unit according to claim 5, wherein the branch hole extends upward from the vertical hole.

7. The cyclonic dust collection unit according to claim 1, wherein the cutaway hole is formed from an upper side of a body of the filter to a lower side of the body.

8. The cyclonic dust collection unit according to claim 1, wherein the cutaway hole is in plurality, of which the uppermost points and/or the lowermost points are disposed at different heights from one another.

9. The cyclonic dust collection unit according to claim 1, wherein the blocking member is provided with an insertion groove in which a first projection of the filter is inserted and a second projection extending inward at both sides of the insertion groove.

10. The cyclonic dust collection unit according to claim 1, wherein the cutaway hole is formed in the filter body and/or the insertion member.

11. The cyclonic dust collection unit according to claim 1, wherein the cutaway hole is formed inclined with respect to an airflow direction in the first filtering chamber.

12. A cyclonic dust collection unit comprising:

a dust collection body;

a plurality of filtering chambers, disposed within the dust collection body, for filtering foreign objects using a cyclone airflow;

a plurality of storing chambers for storing the foreign objects separated through the filtering chambers, respectively;

a plurality of sealing members, in a vertically stacked configuration, each of the plurality of sealing members configured to releasably seal a respective storing chamber in the plurality of storing chambers;

a plurality of sets of connection members interposed between each adjacent pair of sealing members, each adjacent pair comprising a first chamber sealing member and a second chamber sealing member positioned above the first chamber sealing member, each set of connection members comprised of a plurality of spacers, separate and distinct from the dust collection body, connecting a top surface of the first chamber sealing member to a bottom surface of the second chamber sealing member, and configured such that all pairs of chamber sealing members release from their respective foreign object storing chambers, as one structure;

a filter formed of reinforced plastic material and having a plurality of apertures thereon, through which foreign object-filtered air is discharged upward;

an insertion portion formed at a lower portion of the filter, provided with at least one first projection to fix the filter on a blocking member which is disposed under the filter to prevent the foreign objects from flying;

a plurality of airflow preventing plates disposed in a radial direction formed on the bottom of the blocking member, the upper portions of the airflow preventing plates formed with a receiving portion in which the insertion portion is received;

a cutaway hole formed on the filter, extending from an upper part of the filter to the lower part in the shape of a straight line for removing trapped objects on the filter body.

13. The filter structure according to claim 12, wherein the filter body has a conical shape the diameter of which decreases as it goes downward.

14. The filter structure according to claim 12, wherein the filter has a hollow conical shape the diameter of which decreases as it goes downward.

15. The filter structure according to claim 12, wherein the cutaway hole is in plurality, and the plurality of cutaway holes are formed at an equal interval.

16. The filter structure according to claim 12, wherein the cutaway hole is formed in the shape of "Y".

17. The filter structure according to claim 12, wherein the cutaway hole is formed inclined with respect to an airflow direction inside the filtering chamber.

* * * * *